US009928826B2

(12) United States Patent
Judd

(10) Patent No.: US 9,928,826 B2
(45) Date of Patent: Mar. 27, 2018

(54) MUSIC COMPENSATION FOR ACTIVE NOISE CONTROL SYSTEMS

(71) Applicant: Panasonic Automotive Systems Company of America, Division of Panasonic Corporation of North America, Peachtree City, GA (US)

(72) Inventor: Darrel Ray Judd, Pleasant Grove, UT (US)

(73) Assignee: Panasonic Automotive Systems Company of America, Division of Panasonic Corporation of North America, Peachtree City, GA (US)

( * ) Notice: Subject to any disclaimer, the term of this patent is extended or adjusted under 35 U.S.C. 154(b) by 0 days.

(21) Appl. No.: 15/348,042

(22) Filed: Nov. 10, 2016

(65) Prior Publication Data

US 2017/0140747 A1 May 18, 2017

Related U.S. Application Data

(60) Provisional application No. 62/255,064, filed on Nov. 13, 2015.

(51) Int. Cl.
*G10K 11/16* (2006.01)
*G10K 11/178* (2006.01)

(52) U.S. Cl.
CPC .. *G10K 11/1788* (2013.01); *G10K 2210/1282* (2013.01); *G10K 2210/3051* (2013.01); *G10K 2210/511* (2013.01)

(58) Field of Classification Search
CPC ..... G10K 11/1788; G10K 2210/1282; G10K 2210/3051; G10K 2210/511
See application file for complete search history.

(56) References Cited

U.S. PATENT DOCUMENTS

2010/0195844 A1* 8/2010 Christoph ..... G10K 11/178 381/71.11

OTHER PUBLICATIONS

Sen M. Kuo et al., An Integrated Audio and Active Noise Control System, IEEE, 1993, 2529-2532.

(Continued)

*Primary Examiner* — Andrew L Sniezek
(74) *Attorney, Agent, or Firm* — Laurence S. Roach, Esq.

(57) ABSTRACT

A vehicle includes a music signal processing system having a loudspeaker disposed within a passenger compartment of the vehicle and emitting audible music into the passenger compartment. A microphone is disposed within the passenger compartment and converts the audible music and noise within the passenger compartment into an analog electrical microphone signal. An analog-to-digital converter is connected to an output of the microphone and receives the analog electrical microphone signal and converts the analog electrical microphone signal into a digital electrical microphone signal. A sample rate down converter is connected to an output of the analog-to-digital converter. A narrow band adaptive noise control is connected to an output of the sample rate down converter and receives an engine speed signal. A sample rate up converter is connected to an output of the narrow band adaptive noise control. An adder device adds an output of the sample rate up converter to a music signal. A digital-to-analog converter is connected to an output of the adder device. An amplifier has an input connected to an output of the digital-to-analog converter. An output of the amplifier is connected to an input of the loudspeaker.

11 Claims, 7 Drawing Sheets

(56) References Cited

OTHER PUBLICATIONS

P. P. Vaidyanathan, Multirate Systems and Filter Banks, 1993, Prentice Hall.
Swen Muller et al., Transfer-Function Measurement With Sweeps, Director's Cut Including Previously Unreleased Material, AES Journal, Jun. 2001, pp. 1-52.

* cited by examiner

210

MUSIC COMPENSATION FOR ACTIVE NOISE CONTROL SYSTEMS

CROSS-REFERENCED TO RELATED APPLICATIONS

This application claims benefit of U.S. Provisional Application No. 62/255,064 filed on Nov. 13, 2015, which the disclosure of which is hereby incorporated by reference in its entirety for all purposes.

FIELD OF THE INVENTION

The disclosure relates to the field of automotive communication systems, and, more particularly, to systems on a vehicle.

BACKGROUND OF THE INVENTION

FIG. 1 illustrates a typical application of an Adaptive Noise Canceler (ANC) 10 for an automotive application. H(z) represents the transfer function through the digital to analog converter (DAC) 12, amplifier 14, loudspeaker 16, cabin, microphone (MIC) 18, and analog to digital converter ADC 20. The output of H(z) is the error e(n) which is the input to ANC 10. RPM is the revolutions per minute of the engine. Boom(n) represents the periodic engine noise whose dominant frequency is directly related to RPM. Music(n), which represents program content, is added digitally to the ANC output before it is converted to analog. A problem is that Music(n) can be distorted before it reaches the listener's ears if Music(n) is strongly correlated to Boom(n). Many music compensation techniques have appeared in the literature, but their costs to implement have always been prohibitive.

SUMMARY

The present invention may provide a method which reduces the number of instructions per second required to perform music compensation, thus making music compensation practical in an automotive environment. The invention may solve the problem of distortion of program material by an Adaptive Noise Control (ANC) system. The invention can be applied to any environment that requires ANC. The impulse response from the program source to the input of the ANC may be measured. This measured response may be used to remove the unwanted program content from the error input signal of the ANC. This impulse response can be quite large. The invention may provide an innovative approach to implement this measured impulse response.

In one embodiment, the invention comprises a vehicle including a music signal processing system having a loudspeaker disposed within a passenger compartment of the vehicle and emitting audible music into the passenger compartment. A microphone is disposed within the passenger compartment and converts the audible music and noise within the passenger compartment into an analog electrical microphone signal. An analog-to-digital converter is connected to an output of the microphone and receives the analog electrical microphone signal and converts the analog electrical microphone signal into a digital electrical microphone signal. A sample rate down converter is connected to an output of the analog-to-digital converter. A narrow band adaptive noise control is connected to an output of the sample rate down converter and receives an engine speed signal. A sample rate up converter is connected to an output of the narrow band adaptive noise control. An adder device adds an output of the sample rate up converter to a music signal. A digital-to-analog converter is connected to an output of the adder device. An amplifier has an input connected to an output of the digital-to-analog converter. An output of the amplifier is connected to an input of the loudspeaker.

In another embodiment, the invention comprises a vehicle including a music signal processing system having a narrow band adaptive noise control receiving an engine speed signal. A sample rate up converter is connected to an output of the narrow band adaptive noise control. A first adder device adds an output of the sample rate up converter to a music signal. A digital-to-analog converter is connected to an output of the first adder device. An amplifier has an input connected to an output of the digital-to-analog converter. A loudspeaker is disposed within a passenger compartment of the vehicle and has an input connected to an output of the amplifier. The loudspeaker emits audible music into the passenger compartment. A microphone is disposed within the passenger compartment and converts the audible music and noise within the passenger compartment into an analog electrical microphone signal. An analog-to-digital converter is connected to an output of the microphone and receives the analog electrical microphone signal and converts the analog electrical microphone signal into a digital electrical microphone signal. A first sample rate down converter is connected to an output of the analog-to-digital converter. A processor receives the music signal and performs a second transformation on the music signal. The second transformation is an estimate of a first transformation performed on the music signal by the digital-to-analog converter, the amplifier, the loudspeaker, the microphone and the analog-to-digital converter. A second sample rate down converter is connected to an output of the processor. A second adder device subtracts an output of the second sample rate up converter from an output of the first sample rate up converter. The narrow band adaptive noise control receives an output of the second adder device.

In still another embodiment, the invention comprises a vehicle including a music signal processing system having a narrow band adaptive noise control receiving an engine speed signal. A sample rate up converter is connected to an output of the narrow band adaptive noise control. A first adder device adds an output of the sample rate up converter to a music signal. A digital-to-analog converter is connected to an output of the first adder device. An amplifier has an input connected to an output of the digital-to-analog converter. A loudspeaker is disposed within a passenger compartment of the vehicle and has an input connected to an output of the amplifier. The loudspeaker emits audible music into the passenger compartment. A microphone is disposed within the passenger compartment and converts the audible music and noise within the passenger compartment into an analog electrical microphone signal. An analog-to-digital converter is connected to an output of the microphone and receives the analog electrical microphone signal and converts the analog electrical microphone signal into a digital electrical microphone signal. A first sample rate down converter is connected to an output of the analog-to-digital converter. A processor receives the music signal and performs a second transformation on the music signal. The second transformation is an estimate of a first transformation performed on the music signal by the digital-to-analog converter, the amplifier, the loudspeaker, the microphone and the analog-to-digital converter. A second sample rate down converter is connected to an output of the processor.

A second adder device subtracts an output of the second sample rate up converter from an output of the first sample rate up converter. The second sample rate up converter includes a truncation of a transfer function through the digital-to-analog converter, the amplifier, the loudspeaker, the microphone, and the analog-to-digital converter. The narrow band adaptive noise control receives an output of the second adder device.

In a further embodiment, the invention comprises a vehicle including a music signal processing system having a narrow band adaptive noise control receiving an engine speed signal. A sample rate up converter is connected to an output of the narrow band adaptive noise control. A first adder device adds an output of the sample rate up converter to a music signal. A digital-to-analog converter is connected to an output of the first adder device. An amplifier has an input connected to an output of the digital-to-analog converter. A loudspeaker is disposed within a passenger compartment of the vehicle and has an input connected to an output of the amplifier. The loudspeaker emits audible music into the passenger compartment. A microphone is disposed within the passenger compartment and converts the audible music and noise within the passenger compartment into an analog electrical microphone signal. An analog-to-digital converter is connected to an output of the microphone and receives the analog electrical microphone signal and converts the analog electrical microphone signal into a digital electrical microphone signal. A first sample rate down converter is connected to an output of the analog-to-digital converter. A processor receives the music signal and performs a second transformation on the music signal. The second transformation is an estimate of a first transformation performed on the music signal by the digital-to-analog converter, the amplifier, the loudspeaker, the microphone and the analog-to-digital converter. A second sample rate down converter is connected to an output of the processor. A second adder device subtracts an output of the second sample rate up converter from an output of the first sample rate up converter. The second sample rate up converter includes a polyphase filter implementing a convolution of a transfer function through the digital-to-analog converter, the amplifier, the loudspeaker, the microphone, and the analog-to-digital converter with a low pass filter. The narrow band adaptive noise control receives an output of the second adder device.

In yet another embodiment, the invention comprises a method of producing music within a vehicle, including providing a microphone within a passenger compartment of the vehicle. The microphone is used to convert audible music and noise within the passenger compartment into an analog electrical microphone signal. The analog electrical microphone signal is received and converted into a digital electrical microphone signal. A sample rate of the digital electrical microphone signal is downconverted. The downconverted digital electrical microphone signal is transmitted to a narrow band adaptive noise control. An engine speed signal is transmitted to the narrow band adaptive noise control. A sample rate of an output signal of the narrow band adaptive noise control is upconverted. The upconverted output signal is added to a music signal to produce a digital summation signal. The digital summation signal is converted to an analog summation signal. The analog summation signal is amplified. The amplified analog summation signal is transmitted to a loudspeaker disposed within the passenger compartment of the vehicle. Audible music is emitted from the loudspeaker into the passenger compartment dependent upon the amplified analog summation signal.

The present invention has the advantage that it minimizes distortion to audio program material caused by Adaptive Noise Control with reduced implementation cost.

BRIEF DESCRIPTION OF THE DRAWINGS

A better understanding of the present invention will be had upon reference to the following description in conjunction with the accompanying drawings.

DETAILED DESCRIPTION OF THE PREFERRED EMBODIMENTS

Figure 1:
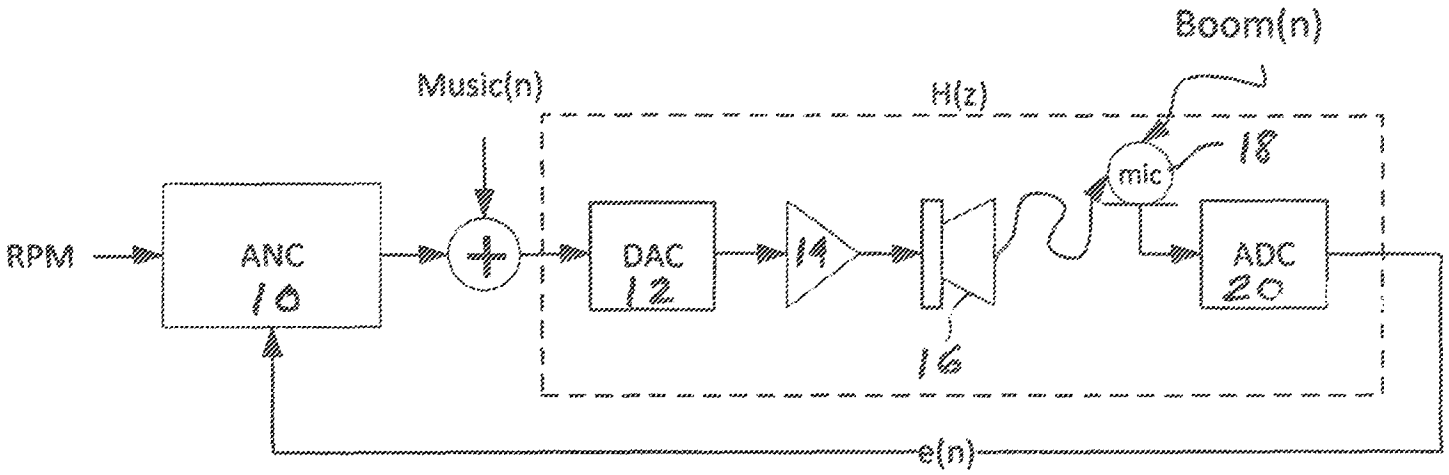
FIG. 1 PRIOR ART
FIG. 1 is a block diagram of one embodiment of a known music signal processing system including an adaptive noise canceler (ANC) for an automotive application.
Figure 2:
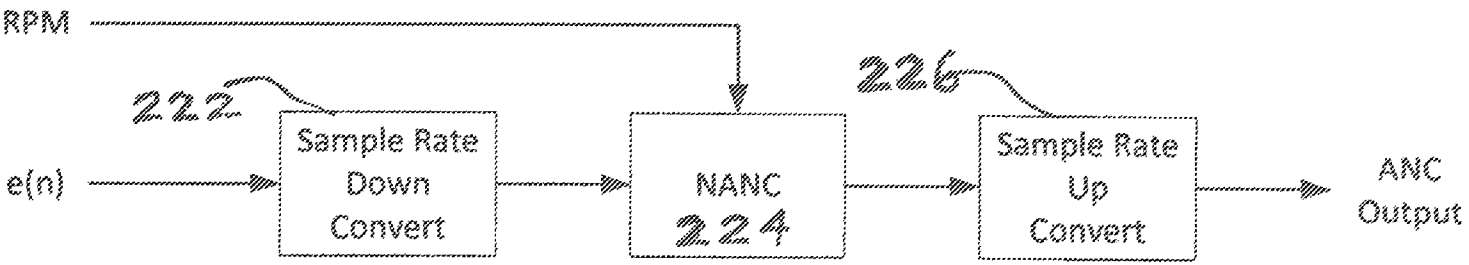
FIG. 2 shows an Adaptive Noise Control decomposed into three blocks, a sample rate down converter, a Narrow band Adaptive Noise Control (NANC), and a sample rate up converter. Sample rate conversion is desirable to decrease computational load.

Typical frequency bandwidths of engine Boom(n) in FIG. 1 are much smaller than the bandwidths required to reproduce music. Therefore, in order to minimize the processing bandwidth required to implement an ANC, the sample rate (FS) may be reduced. For example, a typical FS for music, 48,000 samples/second, could be reduced to 2,000 samples/second for an ANC. This would be a reduction in bandwidth and sample rate by a factor of 24. This reduction factor may be referred to herein as "D" and may be assumed to be an integer. FIG. 2 illustrates an ANC 210 divided into three sections, including: 1) a Sample Rate Down Converter (SRDC) 222 which reduces the sample rate by a factor of D; 2) a NANC (Narrow band ANC) 224 which processes at the reduced FS/D rate; and 3) a Sample Rate Up Converter (SRUC) 226 which increases the sample rate back to FS.

Figure 3:
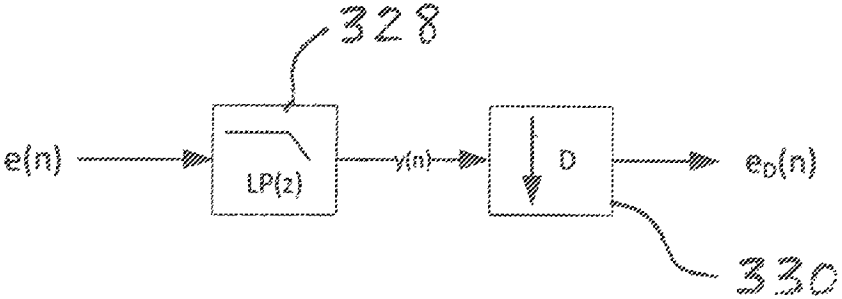
FIG. 3 is a block diagram of one embodiment of the sample rate down converter of FIG. 2.

As shown in FIG. 3, SRDC 222 can be implemented by low pass filtering e(n), as indicated at 328, followed by a D fold decimator 330. SRDC 222 takes an input sequence e(n) and produces an output $e_D(n)=y(Dn)$, where D is an integer.

Figure 4:
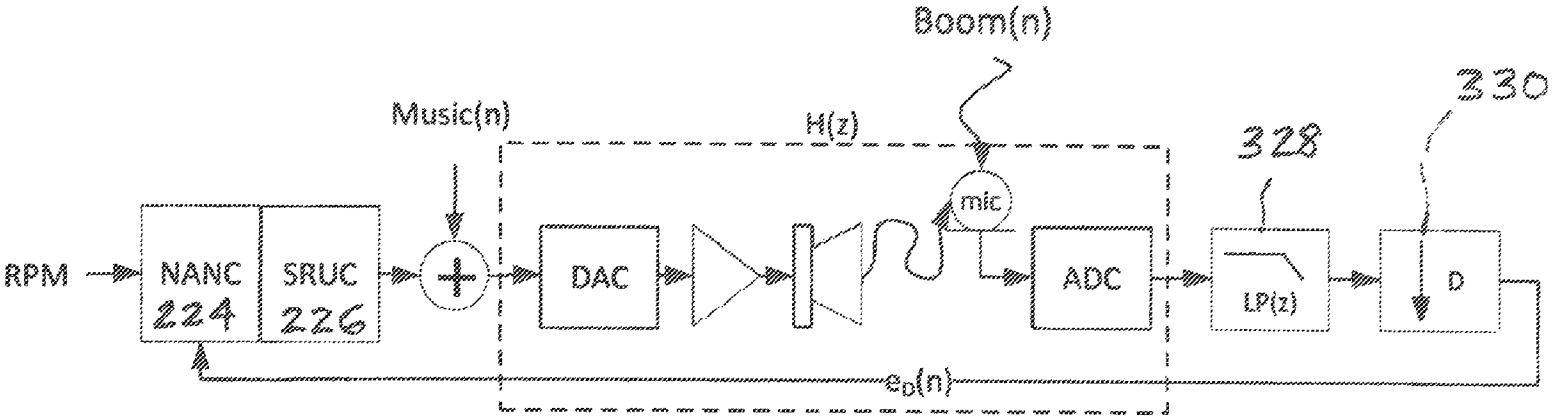
FIG. 4 is a block diagram of one embodiment of a music signal processing system of the present invention including the adaptive noise control (ANC) of FIG. 3 and the sample rate down converter of FIG. 2.
Figure 5:
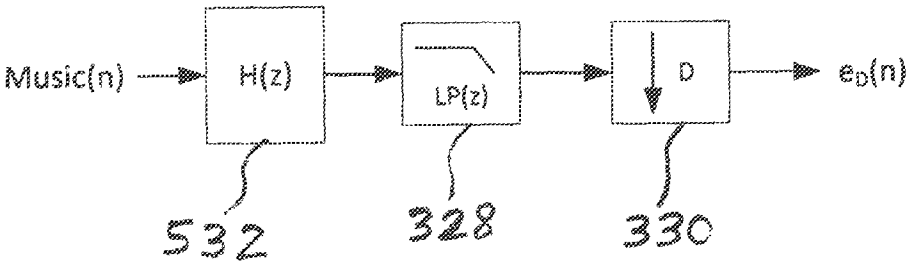
FIG. 5 is a block diagram illustrating the transfer function from the point where Music(n) is added to the output of ANC and the error input of NANC of FIG. 4. H(z) is further defined in FIG. 6.

Substituting the ANC 210 of FIG. 2 and the SRDC 222 of FIG. 3 into FIG. 1 results in the inventive music compensation system of FIG. 4. In order to remove program content from the error signal $e_D(n)$, the transfer function from the point where Music(n) is added to the output of ANC and the error input of NANC may be identified. This transfer function, illustrated in FIG. 5, includes H(z) 532 and the sample rate down conversion.

Figure 6:
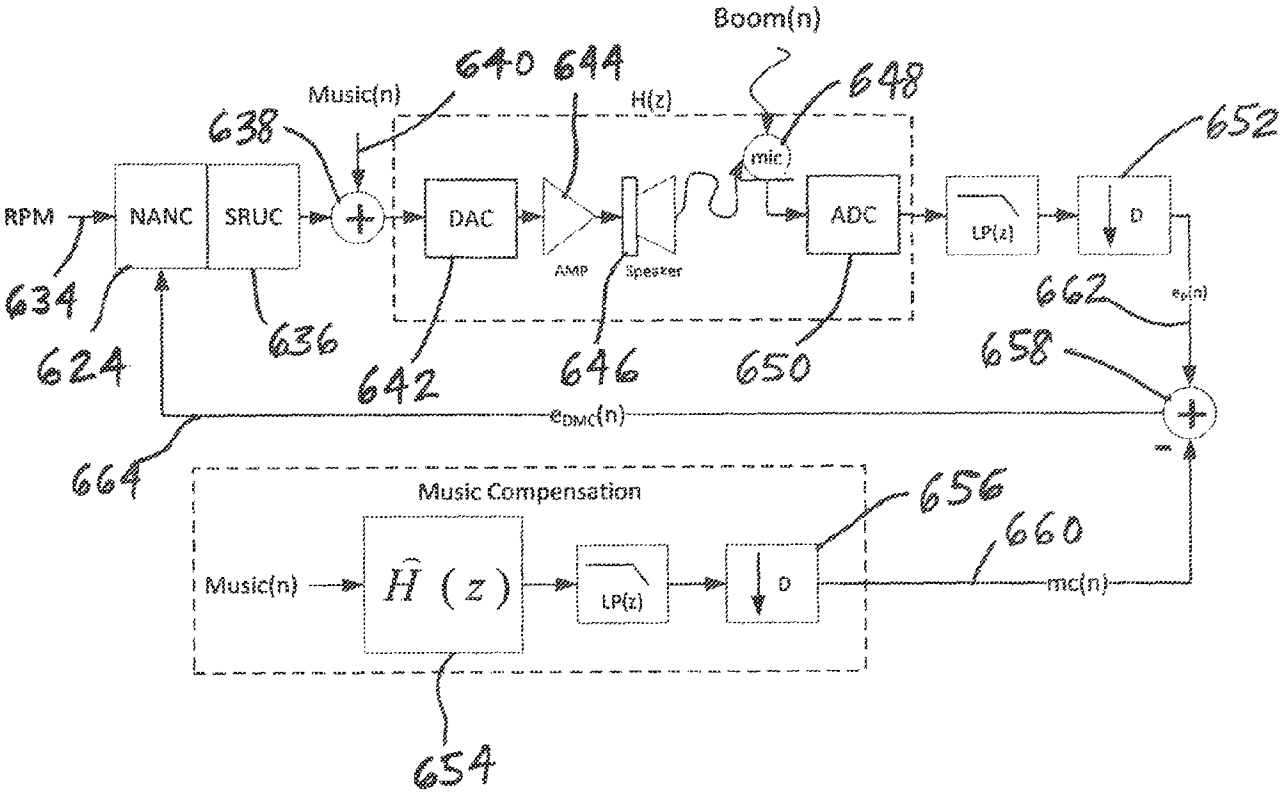
FIG. 6 is a block diagram of an embodiment of the current invention. The transfer function H(z) is estimated using techniques known to those who are skilled in the art.

When Boom(n) and Music(n) are tones at the same frequency, NANC may tend to cancel Music(n) thus distorting program content at the listener's ears. FIG. 6 illustrates another embodiment of a music signal processing system of the present invention. Narrow band adaptive noise control 624 receives an engine speed signal 634. A sample rate up converter 636 is connected to an output of narrow band adaptive noise control 624. A first adder device 638 adds an output of sample rate up converter 636 to a music signal 640. A digital-to-analog converter 642 is connected to an output of first adder device 638. An amplifier 644 has an input connected to an output of digital-to-analog converter 642. A loudspeaker 646 has an input connected to an output of amplifier 644. An analog-to-digital converter 650 is connected to an output of a microphone 648. A first sample rate down converter 652 is connected to an output of analog-to-digital converter 650. A processor 654 receives the music signal. A second sample rate down converter 656 is connected to an output of processor 654. A second adder device 658 subtracts an output 660 of second sample rate down converter 656 from an output 662 of first sample rate down converter 652. Narrow band adaptive noise control 624 receives an output 664 of second adder device 658. In this embodiment, the effects of Music(n) may be removed from the error input to NANC 624. Music(n) cannot be directly subtracted from $e_D(n)$ because it has passed through the transfer function shown in FIG. 5. Therefore, the transfer function of FIG. 5 may be applied to Music(n). To accomplish this, H(z) may be estimated. This estimate can be measured or otherwise arrived at in many different ways. Example processes adequate for estimating H(z) are described by authors Swen Muller and Paulo Massarani in "Transfer-Function Measurement with Sweeps, Director's Cut Including Previously Unreleased Material" (AES Journal, June, 2001); and by author Angelo Farina in "Simultaneous Measurement of Impulse Response and Distortion with a Swept-Sine Technique" (108th AES Convention, Feb. 19-22, 2000, Paris, France).

In FIG. 6 it is seen that the music content is subtracted from $e_D(n)$. However, the estimate of H(z) can be quite large, requiring a large percentage of available processing bandwidth in order to implement.

In order to reduce processing cost, truncation and windowing may be performed. For example, the length of the estimate of H(z) can be shortened. The first step is to create one filter by convolving the estimate of H(z) with LP(z):

$$G(z)=H_{estimate}(z)*LP(z)$$

Figure 7B:
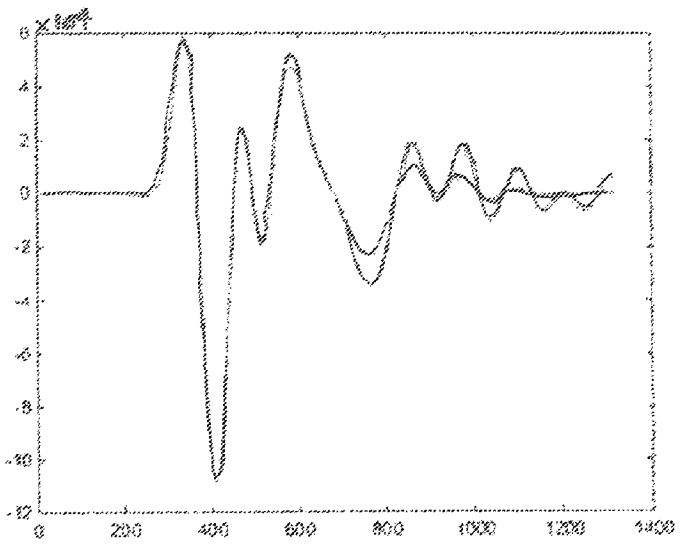
FIG. 7*b* is a plot of truncated filtering and windowed filtering. Computation savings are realized as the size of the impulse response is reduced.
Figure 7A:
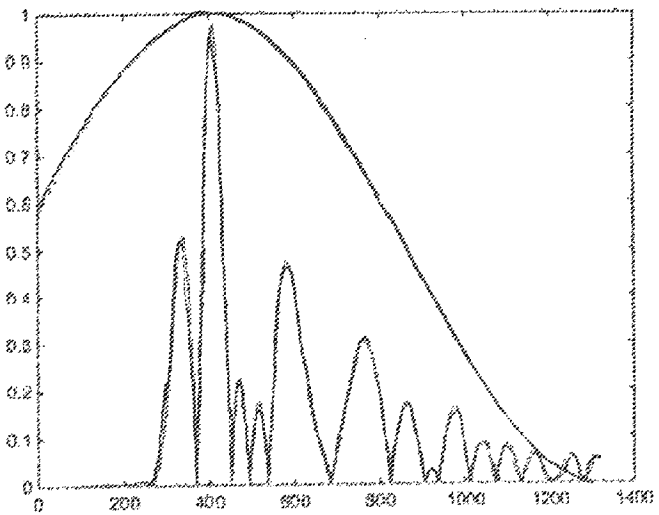
FIG. 7*a* is a plot of filter coefficients and an off centered Hanning window.

G(z) can be shortened by windowing and truncating as shown in FIGS. 7*a-b*. In FIG. 7*a*, the lower frequency bell curve represents an off centered Hanning window, and the higher frequency curve represents filter coefficients. In FIG. 7*b*, the higher amplitude plot represents filter truncated, and the lower amplitude plot represents filter windowed. Let g(n) equal the inverse Z transform of G(z). Truncate g(n) to the desired length. gt(n)=Truncate(g(n)). To do this, align the peak of a Hanning window with the maximum peak of the absolute value of gt(n). Multiply the window with gt(n). gtw=Window(gt(n)). The new length of gtw(n) may be determined by experimentation. There is a tradeoff between the amount of cancelation desired and filter length.

Figure 8:
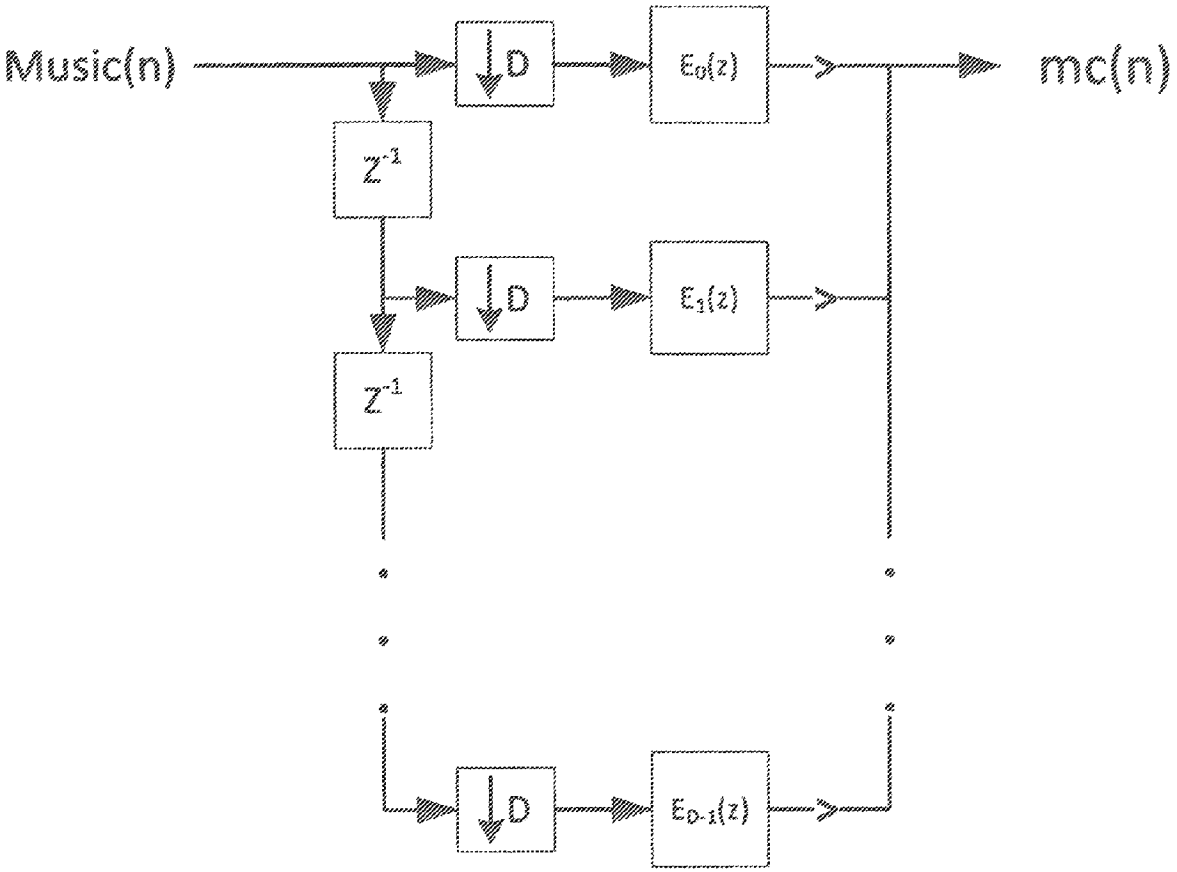
FIG. 8 is a block diagram of one embodiment of a multi-rate topology of the present invention used to implement $\hat{H}(z)*LP(z)$.

Multirate filtering may be performed. Further savings can be had by combining GTW(z) and decimation by D using a polyphase filter. First, the Type 1 polyphase matrix E may be calculated from GTW(z). Then, the multi-rate topology in FIG. 8 can be used to filter and decimate. This decreases the processing required by a factor of D. The length of GTW(z), determined in the previous section, may be an integer multiple of D. Length(GTW(z))=K*D. Where K is an integer and K>0.

The techniques of the present invention may make music compensation for ANC systems affordable and practical. The sample rate down conversion is combined with music compensation, thus allowing multi-rate processing to be used to decrease the MIPS or instructions/second. Further savings can be achieved with windowing and truncating techniques.

The music can be cancelled at the sample rate of FS/D. For example, a 32768 tap filter may be windowed and truncated to 1320 taps. Using polyphase techniques, the equivalent numbers of filter taps may be reduced to 55 for D=24.

It is possible to implement the invention by use of adaptive filters or fixed length finite impulse response (FIR) filters.

Figure 9:
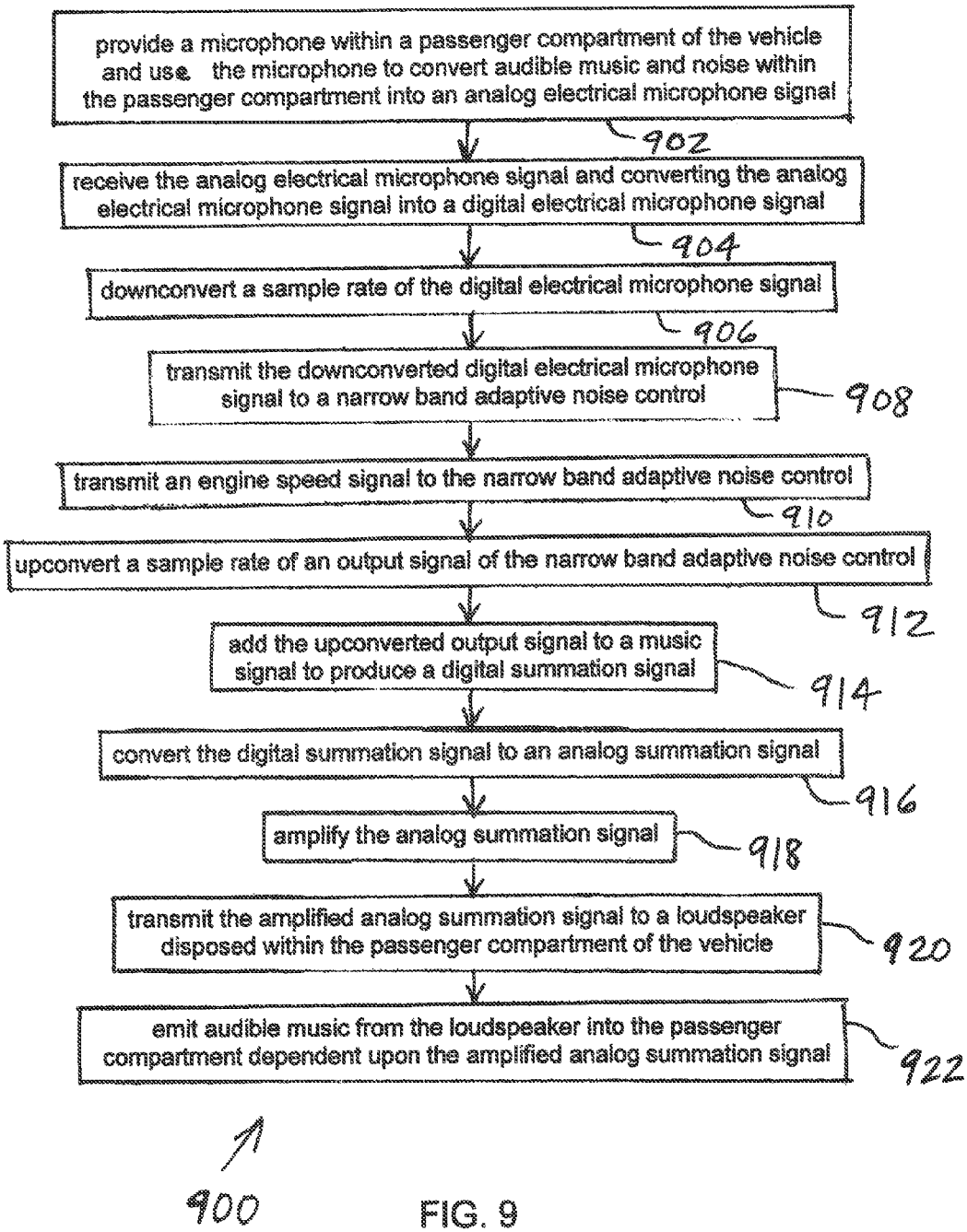
FIG. 9 is a flow chart of one embodiment of a method of the present invention for producing music within a vehicle.

FIG. 9 illustrates one embodiment of a method 900 of the present invention for producing music within a vehicle. In a first step 902, a microphone is provided within a passenger compartment of the vehicle, and the microphone is used to convert audible music and noise within the passenger compartment into an analog electrical microphone signal. For example, the microphone of FIG. 6 may be provided in a passenger compartment of a vehicle, and may be used to convert audible music and noise within the passenger compartment into an analog electrical microphone signal.

In a next step 904, the analog electrical microphone signal is received and the analog electrical microphone signal is converted into a digital electrical microphone signal. For example, the ADC of FIG. 6 may receive the analog electrical microphone signal and convert it into a digital electrical microphone signal.

Next, in step 906, a sample rate of the digital electrical microphone signal is downconverted. For example, as shown in FIG. 3, SRDC 222 can be implemented by low pass filtering e(n), as indicated at 328, followed by a D fold decimator 330.

In step 908 the downconverted digital electrical microphone signal is transmitting to a narrow band adaptive noise control. For example, a NANC (Narrow band ANC) 224 processes at the reduced FS/D rate.

In a next step 910, an engine speed signal is transmitted to the narrow band adaptive noise control. For example, an RPM signal may be received by NANC 224, as shown in FIG. 4.

Next, in step 912, a sample rate of an output signal of the narrow band adaptive noise control is upconverted. For example, a sample rate of an output signal of NANC 224 may be upconverted by SRUC 226.

In a next step 914 the upconverted output signal is added to a music signal to produce a digital summation signal. That is, as shown in FIG. 4, the output of SRUC 226 may be added to the music signal Music(n).

In step 916, the digital summation signal is converted into an analog summation signal. That is, as shown in FIG. 4, the DAC converts the summation of the output of SRUC 226 and the music signal Music(n) into an analog signal.

Next, in step 918, the analog summation signal is amplified. For example, as shown in FIG. 4, the output of the DAC is received by an amplifier.

In a next step 920, the amplified analog summation signal is transmitted to a loudspeaker disposed within the passenger compartment of the vehicle. For example, as shown in FIG. 4, the output of the amplifier is received by a loudspeaker.

In a final step 922, audible music is emitting from the loudspeaker into the passenger compartment dependent upon the amplified analog summation signal. That is the loudspeaker of FIG. 4 may emit audible music based on the received output of the amplifier.

The foregoing description may refer to "motor vehicle", "automobile", "automotive", or similar expressions. It is to be understood that these terms are not intended to limit the invention to any particular type of transportation vehicle. Rather, the invention may be applied to any type of transportation vehicle whether traveling by air, water, or ground, such as airplanes, boats, etc.

The foregoing detailed description is given primarily for clearness of understanding and no unnecessary limitations are to be understood therefrom for modifications can be made by those skilled in the art upon reading this disclosure and may be made without departing from the spirit of the invention.

What is claimed is:

1. A vehicle including a music signal processing system comprising:

a loudspeaker disposed within a passenger compartment of the vehicle and configured to emit audible music into the passenger compartment;

a microphone disposed within the passenger compartment and configured to convert the audible music and noise within the passenger compartment into an analog electrical microphone signal;

an analog-to-digital converter connected to an output of the microphone and configured to receive the analog electrical microphone signal and convert the analog electrical microphone signal into a digital electrical microphone signal;

a sample rate down converter connected to an output of the analog-to-digital converter, the sample rate down converter being configured to perform multi-rate processing, the sample rate down converter including a means to decrease a number of operations performed per second to emit the audible music;

a narrow band adaptive noise control connected to an output of the sample rate down converter and configured to receive an engine speed signal;

a sample rate up converter connected to an output of the narrow band adaptive noise control;

an adder device configured to add an output of the sample rate up converter to a music signal;

a digital-to-analog converter connected to an output of the adder device; and an amplifier having an input connected to an output of the digital-to-analog converter, an output of the amplifier being connected to an input of the loudspeaker.

2. The vehicle of claim 1 wherein the sample rate down converter includes:

a filter connected to an output of the analog-to-digital converter; and a decimator connected to an output of the filter.

3. The vehicle of claim 1 further comprising a filter included in the sample rate down converter, the narrow band adaptive noise control, or the sample rate up converter.

4. The vehicle of claim 1 wherein the noise within the passenger compartment includes periodic engine noise whose dominant frequency is directly related to the engine speed.

5. A vehicle including a music signal processing system, comprising:

a narrow band adaptive noise control configured to receive an engine speed signal;

a sample rate up converter connected to an output of the narrow band adaptive noise control;

a first adder device configured to add an output of the sample rate up converter to a music signal;

a digital-to-analog converter connected to an output of the first adder device;

an amplifier having an input connected to an output of the digital-to-analog converter;

a loudspeaker disposed within a passenger compartment of the vehicle and having an input connected to an output of the amplifier, the loudspeaker being configured to emit audible music into the passenger compartment;

a microphone disposed within the passenger compartment and configured to convert the audible music and noise within the passenger compartment into an analog electrical microphone signal;

an analog-to-digital converter connected to an output of the microphone and configured to receive the analog electrical microphone signal and convert the analog electrical microphone signal into a digital electrical microphone signal;

a first sample rate down converter connected to an output of the analog-to-digital converter;

a processor receiving the music signal and configured to perform a second transformation on the music signal, the second transformation being an estimate of a first transformation performed on the music signal by the digital-to-analog converter, the amplifier, the loudspeaker, the microphone and the analog-to-digital converter;

a second sample rate down converter connected to an output of the processor; and a second adder device configured to subtract an output of the second sample rate down converter from an output of the first sample rate down converter, the narrow band adaptive noise control receiving an output of the second adder device.

6. The vehicle of claim 5 wherein the first sample rate down converter includes:

a first low pass filter connected to an output of the analog-to-digital converter; and a first decimator connected to an output of the first low pass filter; and the second sample rate down converter includes:

a second low pass filter connected to an output of the processor; and a second decimator connected to an output of the second low pass filter.

7. The vehicle of claim 5 wherein each of the first sample rate down converter and the second sample rate down converter is configured to perform multi-rate processing.

8. The vehicle of claim 7 wherein each of the first sample rate down converter and the second sample rate down converter comprises a means to decrease a number of operations performed per second to emit the audible music.

9. The vehicle of claim 5 wherein a windowed filter is included in the first sample rate down converter, the second sample rate down converter, the narrow band adaptive noise control, and/or the sample rate up converter.

10. The vehicle of claim 5 wherein a truncated filter is included in the first sample rate down converter, the second sample rate down converter, the narrow band adaptive noise control, and/or the sample rate up converter.

11. The vehicle of claim 5 wherein the noise within the passenger compartment includes periodic engine noise whose dominant frequency is directly related to the engine speed.

* * * * *